United States Patent [19]

Anderson

[11] Patent Number: 4,932,174

[45] Date of Patent: Jun. 12, 1990

[54] POLYURETHANE SHOE SUPPORT

[76] Inventor: Dwayne B. Anderson, 2762 Blume Dr., Los Alamitos, Calif. 90720

[21] Appl. No.: 395,975

[22] Filed: Aug. 21, 1989

[51] Int. Cl.[5] ..... F04B 1/62

[52] U.S. Cl. ..... 52/98; 52/182; 52/309.16; 52/393; 52/292; 52/741

[58] Field of Search ..... 52/126.3, 98, 301, 99, 52/309.15, 309.16, 100, 403, 393, 292, 296, 58; 248/188.9, 678; 411/908, 42

[56] References Cited

U.S. PATENT DOCUMENTS

| | | | |
|---|---|---|---|
| 2,859,486 | 11/1958 | Rovich | 52/293 |
| 3,114,940 | 12/1963 | Rockabrand | 52/403 |
| 3,197,358 | 7/1965 | Angioletti | 52/403 |
| 3,315,923 | 4/1967 | Young | 248/188.9 |
| 3,337,167 | 8/1967 | Johnson | 248/188.9 |
| 3,733,757 | 5/1973 | Scott | 52/126.1 |
| 3,852,931 | 12/1974 | Morse | 52/293 |
| 3,892,902 | 7/1975 | Ilukowicz | 52/98 |
| 4,210,698 | 7/1980 | Watson | 52/403 |
| 4,336,879 | 6/1982 | Carr | 52/98 |
| 4,784,364 | 11/1988 | Chamberlain | 52/126.5 |

FOREIGN PATENT DOCUMENTS

| | | | |
|---|---|---|---|
| 61371 | 4/1912 | Switzerland | 248/188.9 |

*Primary Examiner*—John E. Murtagh

*Attorney, Agent, or Firm*—Grant L. Hubbard

[57] ABSTRACT

A metal-reinforced polyurethane shoe protecting the lower end of a wood support system from shallow water or moisture on a floor, said shoe comprising a high-density polymer impregnating a rust-resistant metal mesh, and attached to the bottom surface of a wood support system by means of a wood screw or like fastener, thereby protecting the wood support system from the water and moisture accumulating on a potentially wet surface, thus preventing the occurrence of dry rot in the lower end of a wood support system.

6 Claims, 1 Drawing Sheet

POLYURETHANE SHOE SUPPORT

BACKGROUND OF THE INVENTION

1. Field of the Invention

The present invention relates generally to building construction and, more particularly, to protecting the lower end of wood support systems by means of a high-density metal-reinforced polyurethane shoe support.

2. Description of the Prior Art

It is common in the construction of buildings, whether public or private, to support internal structures such as beams, ceiling joists, walkways and staircases by means of wood support systems. The wood support systems rest on the lower floor and provides support in holding up the aforementioned internal structures. The wood support systems include, but are not limited to, wood posts, timbers or stair stringers.

A problem arises when the surface upon which the wood support system rests is subjected to periodic shallow accumulations of water or moisture resulting in the lower end of the wood support system to be repeatedly wetted and dried. It is common knowledge among those in the construction trade that when wood is cut by a saw, or like instrument, the wood fibers are then exposed to the surrounding environment, and when that environment involves the exposed wood fibers being repeatedly wetted and dried, a fungal condition arises known as dry rot, a condition where the wood fibers have been attacked and weakened or destroyed by the fungus. As a result of the aforementioned dry rot, it is then necessary to replace the wood support system within the building, often at great expense and inconvenience.

Those in the construction trade have frequently tried to overcome the above-mentioned problem by resting the wood support systems upon pieces of wood, rock, cement, or metal, often with little or no long term success. Two of the main problems that arise when the wood support systems rest upon pieces of wood are that the pieces of wood may act as a wick in carrying the water, sought to be escaped, up to the bottom surface of the wood support system resulting in the aforementioned dry rot and also the pieces of wood themselves are subject to the same dry rot. When pieces of rock or cement are used, they frequently provide an unstable support, thus making the whole system unsteady. Using metal, as expected, results in the oxidation of the metal and, over a long term, the loss of the needed support, and also, the oxidation of the metal may adversely affect the wood resting upon it.

SUMMARY OF THE PRESENT INVENTION

The present invention of a metal-reinforced polyurethane shoe overcomes the above-mentioned problem by keeping the lower end of the wood support system from direct contact with a potential wet surface.

The polyurethane is not affected by water as is wood and metal, is more stable than rock or cement and does not wick moisture up to the wood surface resting upon it.

The metal-reinforced polyurethane shoe consists of a high-density polyurethane impregnating a rust-resistant metal mesh, having a series of connected segments with a breakable portion, with preformed holes in each segment allowing for attaching to the bottom surface of the lower end of a wood support system by fasteners such as wood screws, holding the wood approximately one inch off the potentially wet surface, thus keeping the wood surface from becoming repeatedly wet and then dry, leading to dry rot.

DESCRIPTION OF THE PREFERRED EMBODIMENTS

Figure 1:
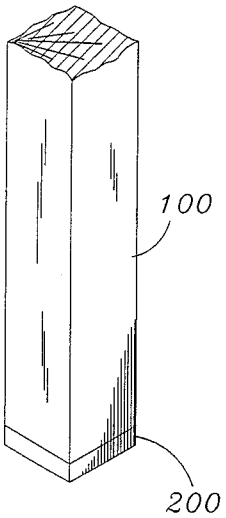
FIG. 1 is a overall view of the metal-reinforced polyurethane shoe attached to the lower end of a wood support system, a wooden post being specifically shown.

Referring to FIG. 1, the drawing shows the metal-reinforced polyurethane shoe 200 attached to the bottom surface of the lower end of a wooden support system 100, specifically shown is a wooden post, but this is not to be used to limit the use of the polyurethane shoe as it has applicability to all wood support systems within a building, examples of such wood support systems being wooden posts, timbers and stair stringers.

Figure 2:
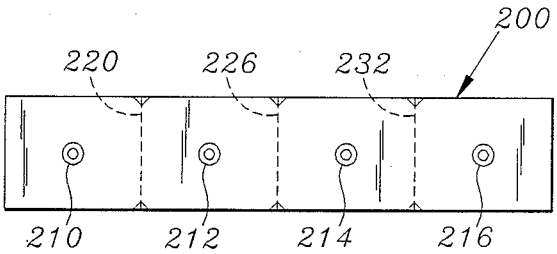
FIG. 2 is a bottom view of the metal-reinforced polyurethane shoe showing the location of preformed, counter-sunk holes and the scoring for adjustability.
Figure 3:
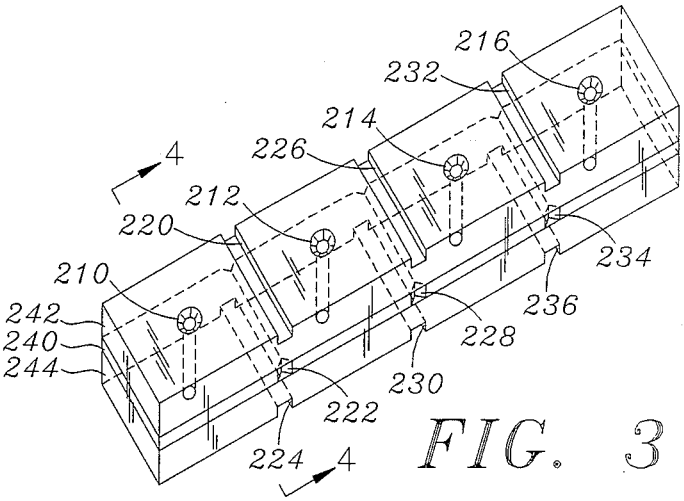
FIG. 3 is a view from the bottom-end corner showing three surfaces and better depicting the scoring for adjustability.
Figure 5:
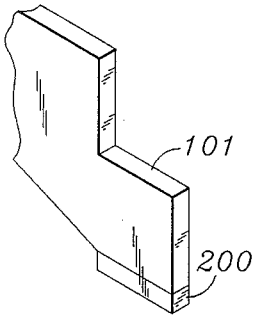
Figure 4:
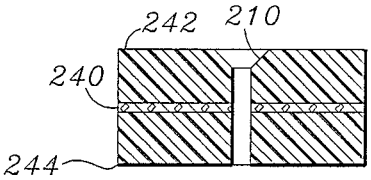
FIG. 4 is a cross-sectional view of the polyurethane shoe showing the sandwich appearance of the metal mesh and polyurethane sheets and the preformed hole that allows for attachment by a fastener such as a wood screw.

Referring to FIGS. 2–4, the drawings show the metal-reinforced polyurethane shoe 200 comprises a series of connected segments with a breakable portion, having preformed holes 210, 212, 214, 216 in the respective segments to allow for attaching to the bottom surface of the lower end of a wood support system by fasteners such as wood screws.

Still referring to FIGS. 2–4, the polyurethane shoe 200 is composed of a scored, rust-resistant metal mesh 240 sandwiched and impregnated between layers of high-density polyurethane 242, 244. Each of the components 240, 242, 244 is scored as depicted by grooves 220, 222, 224, the scoring of the mesh being aligned with the grooves in the polyurethane, allowing for ease in breaking off of one or more segments so the shoe is the same size as the bottom surface of the wood support system. It is noted that the scoring 220, 222, 224 is positioned so that when the segment is broken off, the surface is left even and not jagged.

Thus, the polyurethane shoe is constructed of a high-density polyurethane impregnating a rust-resistant metal mesh, thus, in essence, forming three layers, said mesh providing strength and integrity to the finished unit, with the polyurethane being of sufficient thickness to hold the wood support system out of shallow accumulations of water and moisture and without conducting said moisture to the wood fibers of the wood support system. Each of the three layers of the polyurethane shoe is scored at selected but identical lengths to allow for adjustability of said shoe to the size of the surface of the wood support system sought to be protected, and has preformed holes in each segment to allow attachment to said surface of the lower end of the wood support system by fasteners such as a wood screw.

The polyurethane shoe can be manufactured in varying sizes ranging from about two inches to about eight inches or more in width, and from about four inches to about twelve inches or more in length, with the finished unit being approximately one inch thick.

Although polyurethane is used in this invention and is the preferred choice, it is to be noted that other polymers can also be used, examples of such polymers being: polystyrene, polycarbonate, polyamide, phenol-formaldehyde resins, and polychloroprene elastomers, the preceding examples not limiting the scope of the invention.

The polyurethane shoe support is attached to the bottom surface of the lower end of the wood support system at the time the wood support systems are installed to provide support to the internal structures such as ceiling joists, beams, stair stringers, or other such stringers. The polyurethane shoe supports are of greatest value when used on basement floors or the first floor, the floors that are most commonly subject to shallow accumulations of water or the collection of moisture, but can also be used on other floors.

This invention thus comprises as a combination an improved wood support system providing support to the internal structures of the building, the improvement comprising a polyurethane shoe support attached to the bottom surface of the lower end of a wood support system, the polyurethane shoe comprising a high-density polyurethane polymer impregnating a rust-resistant metal mesh, the polyurethane layers and metal mesh being scored at selected but identical lengths, such scoring allowing for short segments to be broken off whereby the polyurethane shoe can be adjusted to the size of the surface of the wood support system, the polyurethane and metal mesh shoe being of about two to about eight inches or more in width and about four to about twelve inches or more in length, and about one inch in thickness, preformed holes in each segment of the polyurethane shoe allowing for attachment to the wood support system by means of a wood screw or other like fastener.

INDUSTRIAL APPLICATION

This invention is useful in residential and business building construction.

What is claimed is:

1. A building structure comprising a floor, a wood post or stair stringer, and a polymer shoe, said polymer shoe comprising:

(a) a high-density polymer impregnating a rust-resistant metal mesh;

(b) the polymer and metal mesh forming a shoe and being of about two to about eight inches or more in width, and of about four to about twelve inches or more in length, and of about one inch in thickness.

2. The building structure of claim 1, wherein the polymer and metal mesh are each scored at selected lengths, allowing for short segments to be broken off, thereby adjusting the polymer shoe to the size of the bottom surface of the lower end of the wood port or stair stringer.

3. The building structure of claim 2, wherein there is a preformed hole in each segment of the polymer shoe allowing for attaching by means of a wood screw or like fastener to the bottom surface of the lower end of the wood post or stair stringer.

4. A method for supporting and protecting the lower end of a wood post or stair stringer from water wicking and dry rot comprising:

(a) supporting the lower end of the wood support system on a metal-reinforced polymer shoe comprising:

(1) a high-density polymer impregnating a rust-resistant metal mesh;

(2) the polymer and metal mesh forming a shoe and being of about two to about eight inches or more in width, and of about four to about twelve inches or more in length, and of about one inch in thickness.

5. The method of claim 4 wherein the polymer and metal mesh are each scored at selected lengths, allowing for short segments to be broken off, thereby adjusting the polymer shoe to the size of the bottom surface of the lower end of the wood post or stair stringer.

6. The method of claim 5, wherein there is a preformed hole in each segment of the polymer shoe allowing for attachment by means of a wood screw or like fastener to the bottom surface of the lower end of the wood post or stair stringer.

* * * * *